US006048423A

United States Patent [19]

Barrash et al.

[11] Patent Number: 6,048,423

[45] Date of Patent: Apr. 11, 2000

[54] LABELING PROCESS AND APPARATUS

[75] Inventors: Marshall J. Barrash, Atlanta; Jonathan Kirschner, Powder Springs, both of Ga.

[73] Assignee: The Coca-Cola Company, Atlanta, Ga.

[21] Appl. No.: 08/864,108

[22] Filed: May 28, 1997

[51] Int. Cl.[7] ..... B65C 9/20

[52] U.S. Cl. ..... 156/86; 156/85; 156/556; 156/566; 156/567; 156/568; 156/571

[58] Field of Search ..... 156/556, 566, 156/567, 568, 571, 84, 85, 86, DIG. 12, DIG. 13, DIG. 34, DIG. 35, 215; 40/310; 118/261, 244; 427/208.6

[56] References Cited

U.S. PATENT DOCUMENTS

| | | | |
|---|---|---|---|
| 892,702 | 7/1908 | Wyman . | |
| 1,885,345 | 11/1932 | Guthrie . | |
| 1,937,468 | 11/1933 | Talbot . | |
| 2,029,131 | 1/1936 | Shoemaker . | |
| 2,741,885 | 4/1956 | Allison . | |
| 2,751,629 | 6/1956 | Dick . | |
| 2,790,285 | 4/1957 | Pike et al. . | |
| 2,873,717 | 2/1959 | Griffin, Jr. et al. | 118/204 |
| 2,875,726 | 3/1959 | Anness | 118/212 |
| 2,878,628 | 3/1959 | Curry . | |
| 3,152,334 | 10/1964 | Lingle . | |
| 3,235,112 | 2/1966 | Fillwalk et al. . | |
| 3,400,810 | 9/1968 | Makowski . | |
| 3,426,118 | 2/1969 | Chapman et al. . | |
| 3,523,403 | 8/1970 | Collins . | |
| 3,604,584 | 9/1971 | Shank, Jr. . | |
| 3,659,394 | 5/1972 | Hartleib et al. . | |
| 3,734,273 | 5/1973 | Watanabe . | |
| 3,738,524 | 6/1973 | Richie . | |
| 3,823,032 | 7/1974 | Ukai . | |
| 3,829,348 | 8/1974 | Spiegel et al. . | |
| 4,004,705 | 1/1977 | Fujio . | |
| 4,108,110 | 8/1978 | Berry . | |
| 4,108,709 | 8/1978 | Hoffmann . | |
| 4,172,873 | 10/1979 | Spicer . | |
| 4,219,124 | 8/1980 | Amberg . | |
| 4,220,075 | 9/1980 | Bromberg . | |
| 4,225,049 | 9/1980 | Inoue . | |
| 4,245,452 | 1/1981 | Fujio . | |
| 4,285,746 | 8/1981 | DuPuy et al. . | |
| 4,379,009 | 4/1983 | Shibata et al. . | |
| 4,406,721 | 9/1983 | Hoffmann . | |
| 4,416,714 | 11/1983 | Hoffmann . | |
| 4,500,386 | 2/1985 | Hoffman . | |
| 4,545,832 | 10/1985 | Hoffman . | |
| 4,574,020 | 3/1986 | Fosnaught | 156/80 |
| 4,626,455 | 12/1986 | Karabedian . | |
| 4,694,633 | 9/1987 | Fujio et al. . | |

(List continued on next page.)

FOREIGN PATENT DOCUMENTS

| | | |
|---|---|---|
| 0 607863 | 7/1994 | European Pat. Off. . |
| 607863 | 7/1994 | European Pat. Off. . |
| 57-23520 | 5/1982 | Japan . |
| 3-200533 | 9/1991 | Japan . |

*Primary Examiner*—Jeff H. Aftergut
*Attorney, Agent, or Firm*—Finnegan, Henderson, Farabow, Garrett & Dunner, L.L.P.

[57] ABSTRACT

In a method for applying labels about a bulbous sidewall region of a container, the leading end of the label is joined to the bulbous sidewall region by adhesive bonds above and below a major diameter section of the bulbous sidewall region. While being pressed to the bulbous sidewall region, the label is wrapped about the container, and the trailing end of the label is then adhesively joined to the bulbous sidewall region, or to the overlapped leading end of the label. An apparatus for applying labels about a bulbous sidewall region of a container employs a label transfer drum which cooperates with an adhesive applicator to apply spaced adhesive patches to the leading end of the label above and below a major diameter section of the bulbous sidewall region. The label transfer drum also cooperates with the adhesive applicator to apply a continuous strip of adhesive to the trailing end of the label. An arcuate backing wall with a yieldable surface forms, with the cylindrical surface of the label transfer drum, a passage through which the container rolls while the label is pressed to and wrapped about the bulbous sidewall region of the container.

54 Claims, 4 Drawing Sheets

U.S. PATENT DOCUMENTS 4,704,173 11/1987 Hoffman .
4,726,872 2/1988 Olsen ..... 156/455
4,735,668 4/1988 Hoffmann et al. .
4,844,760 7/1989 Dickey .
4,844,957 7/1989 Hoffman .
4,872,931 10/1989 Mitchell .
4,923,557 5/1990 Dickey .
4,976,798 12/1990 Hoffman .
4,977,002 12/1990 Hoffman .
5,091,239 2/1992 Przeworski et al. .
5,403,416 4/1995 Bright et al. .
5,464,495 11/1995 Eder .
5,512,120 4/1996 Hinton et al. .

LABELING PROCESS AND APPARATUS

BACKGROUND OF THE INVENTION

The present invention relates to a process and an apparatus for applying labels to containers. More particularly, the present invention relates to a process and an apparatus for applying labels to the sidewall of containers having a circular cross-section and a sidewall region which is rounded, or bulbous. The process and apparatus of the present invention are particularly applicable to the labeling of polyethylene terephthalate (PET) beverage bottles.

Applying a label to containers with a bulbous sidewall region, such as the familiar COCA-COLA bottle, is a particularly difficult undertaking. Labels of flexible sheet material can easily conform to a flat surface or a cylindrical surface. But, for such a label to conform to a bulbous surface, it must be gathered, forming wrinkles, or deformed by stretching or shrinking.

In a known technique for applying a label to the bulbous sidewall of a container, the label, of heat shrinkable material, is formed into a sleeve with the overlapping ends secured together. The label sleeve is placed over the container and is then exposed to heat to shrink the label into conformance with the bulbous contour. The manipulation of the label to form the sleeve and then place the sleeve over the bottle requires equipment that is complex and expensive.

In a known technique for wrapping a label about a bulbous sidewall of a container, disclosed in U.S. Pat. No. 5,403,416 (Bright et al.), the leading edge of a heat-shrinkable label is adhesively attached to a narrow area at or adjacent to the maximum diameter of the bulbous region of a bottle. The regions of the leading edge of the label at either side of the adhesive bond are not attached to the bottle sidewall. The label is then wrapped about the bottle, and the trailing end is adhesively attached to the bottle or to an overlapped region of the leading end. The bottle, with the label wrapped in sleeve-like form, then moves past hot air jets to shrink the label into conformance with the bottle contour. A problem with this method is that the adhesive can interfere with the placement of the leading edge of the label on the bottle sidewall, due to the location of the adhesive in coincidence with the maximum diameter region of the bottle. Also, the small size of the adhesive bond between the bottle sidewall and leading edge of the label can compromise the stability of the label as it is subsequently wrapped about the bottle.

Because of the shortcomings of known methods for applying a label to a bulbous sidewall region of a container, a method, and an apparatus, for carrying out the labeling of such containers, which is not hampered by these shortcomings, would be most welcome.

OBJECTS AND SUMMARY OF THE INVENTION

Accordingly, it is a primary object of the present invention to provide a reliable method for satisfactorily applying labels to the bulbous sidewall region of containers.

It is another object of the present invention to provide an apparatus of relatively simple construction which reliably and satisfactorily applies labels to the bulbous sidewall region of containers.

The foregoing objects of the present invention and others as well are fulfilled by providing a process for applying a label bounded by side margins and first and second ends to a bulbous sidewall region of a container of generally circular cross-section, wherein the bulbous sidewall region includes a major diameter section between sections which are of smaller diameter than the major diameter section, comprising the steps of: (a) joining outlying areas along the first end of the label to the bulbous sidewall region at locations within the smaller diameter sections, the outlying areas of the label being separated by a central area along the first end of the label which overlies, and is not joined to, the major diameter section of the bulbous sidewall region; (b) wrapping the label about the bulbous sidewall region until the second end of the label confronts the bulbous sidewall region; (c) joining the second end of the label to the bulbous sidewall region; and (d) forming the side margins of the label against underlying areas of the bulbous sidewall region.

The objects of the present invention are also fulfilled by providing a process for applying a label bounded by side margins and first and second ends to a bulbous sidewall region of a container of generally circular cross-section, wherein the bulbous sidewall region includes a major diameter section between sections which are of smaller diameter than the major diameter section, comprising the steps of: (a) applying adhesive patches to the outlying areas only of the first end of the label; (b) applying a continuous strip of adhesive to a major portion of the second end of the label between the side margins; (c) placing the first end of the label over the bulbous sidewall region with the adhesive on the outlying areas confronting the smaller diameter sections; (d) applying pressure at spaced locations within the outlying areas to press the outlying areas against the bulbous sidewall region and produce adhesive bonds where the outlying areas contact the bulbous sidewall region; (e) positioning the bulbous sidewall region and the first end of the label against a yieldable surface; and (f) rolling the container over the yieldable surface while urging the container against the yieldable surface to (1) wrap the label about the bulbous sidewall region until the second end of the label overlaps and confronts the first end of the label (2) cause deformation of the yieldable surface while progressively pressing the label between the bulbous sidewall region and the yieldable surface, (3) effect a progressive conformation of the side margins of the label over the underlying areas of the bulbous sidewall region and (4) press the second end of the label against the first end and the underlying bulbous sidewall region to produce an adhesive bond between the overlapped ends of the label.

The objects of the present invention are also fulfilled by providing an apparatus for applying a label bounded by side margins and first and second ends to a bulbous sidewall region of a container of generally circular cross-section, wherein the bulbous sidewall region includes a major diameter section between sections which are of smaller diameter than the major diameter section, the apparatus comprising: means for joining outlying areas along the first end of the label to the bulbous sidewall region at locations within the smaller diameter sections, the outlying areas of the label being separated by a central area along the first end of the label which overlies, and is not joined to, the major diameter section of the bulbous sidewall region; means for wrapping the label about the container until the second end of the label confronts the bulbous sidewall region; means for joining the second end of the label to the bulbous sidewall region; and means for forming the side margins of the label against underlying areas of the bulbous sidewall region.

The detailed description of preferred embodiments which follows, to be read in conjunction with the accompanying drawings, will afford a comprehensive understanding of the present invention. However, preferred embodiments of the invention should be regarded as illustrative only, since various modifications within the spirit and scope of the invention may become apparent to persons of ordinary skill in the art who have benefitted from this disclosure.

DETAILED DESCRIPTION OF PREFERRED EMBODIMENTS

Figure 1:
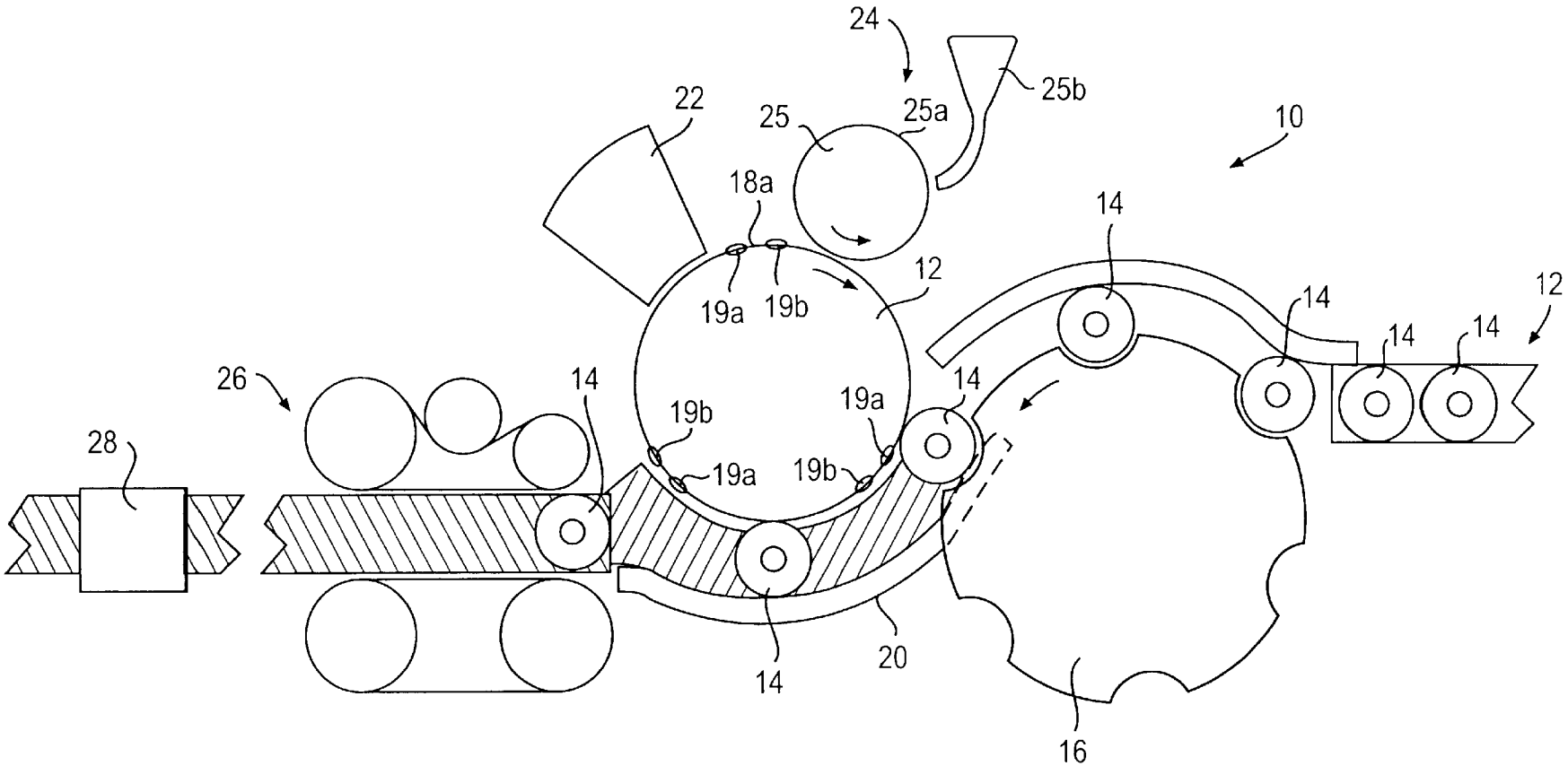
FIG. 1 is a schematic illustration, in plan, of a labeling apparatus constructed according to the present invention.

As illustrated in FIG. 1, a labelling apparatus 10 according to the present invention includes a feed conveyor 12 for a queue of bottles 14 to be labeled, one at a time, an indexing wheel 16 for effecting a uniform separation of individual bottles, a label transfer drum 18, a backing wall 20 having an arcuate surface which confronts and is concentric with the outer surface of drum 18, a label feeder 22, an adhesive applicator assembly 24, a discharge conveyor 26 and a heating station 28. The bottles may, for example, be PET beverage bottles with sidewalls which exhibit some flexibility. The indexing wheel and the label feeder may be of known construction and operation. The label feeder, for example, may be one which cuts individual labels from a web and presents them one at a time to the outer surface of the label transfer drum.

Figure 2:
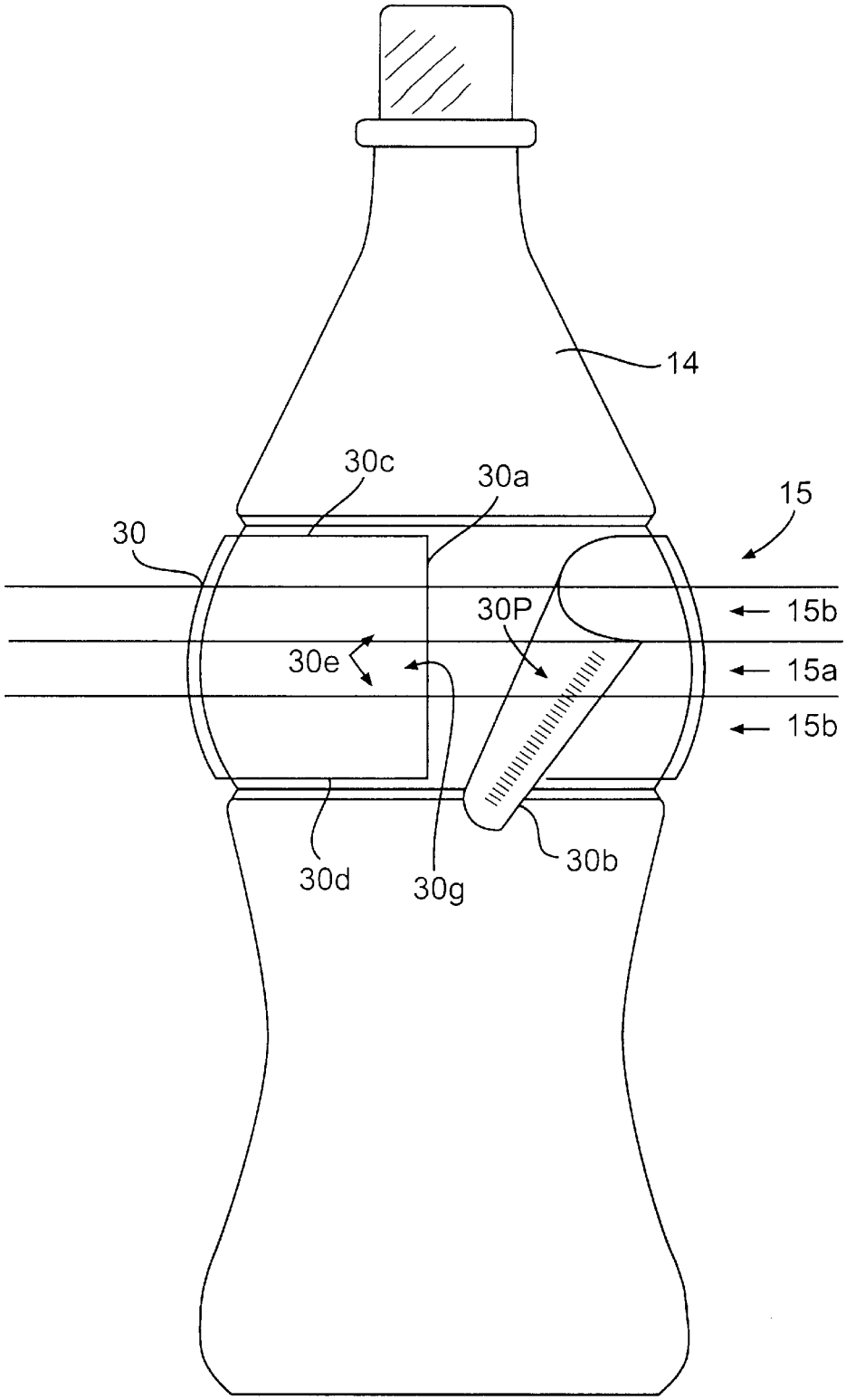
FIG. 2 is an illustration, in elevation, of a container with a label partially applied to a bulbous sidewall region of the container according to the present invention.

A bottle 14 to be labeled, as illustrated in FIG. 2, exhibits a bulbous sidewall region 15 which is of generally circular cross-section and which is defined in part by a major diameter section 15*a* between sections 15*b* of somewhat smaller diameter. The label 30 to be applied to the bulbous sidewall region of the bottle has a first end 30*a*, shown joined to the bulbous sidewall region, a second end 30*b* and upper and lower side margins 30*c*, 30*d*.

The first end 30*a* of the label is joined to the bulbous sidewall region at outlying areas 30*e* along the first end of the label which overlie the smaller diameter sections 15*b* of the bulbous sidewall region and are separated by a central area 30*g* which overlies, but is not joined to, the major diameter section. As illustrated, the outlying areas 30*e* along the first end of the label are joined to the bulbous sidewall region by discreet adhesive patches. A strip of adhesive 30*f*, applied to the second end of the label, may be used for joining the second end of the label to the first end.

Figure 3:
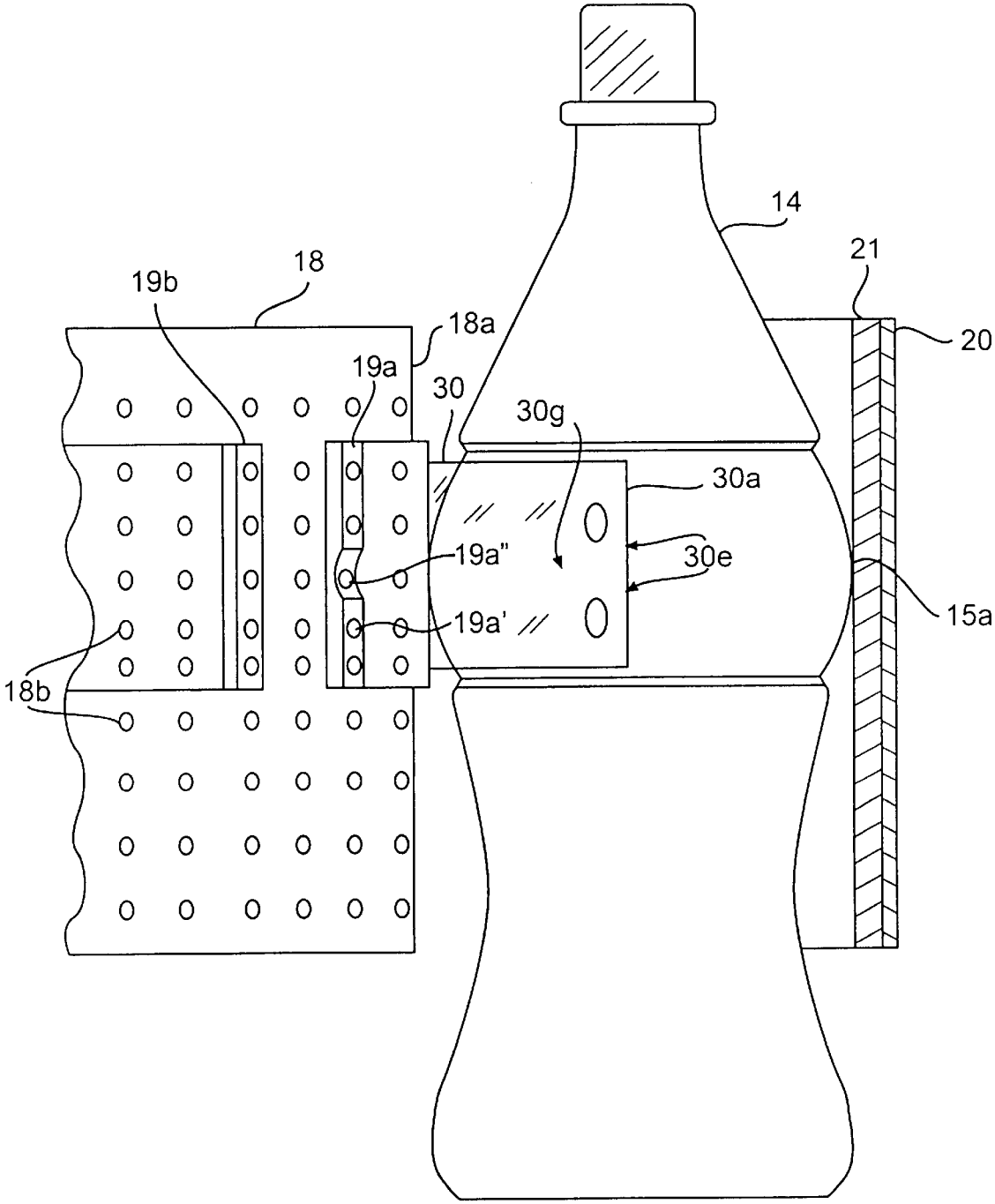
FIG. 3 is a partly cross-sectional illustration, in elevation, showing a container, with a partially applied label, positioned between the label transfer drum and the arcuate backing wall.

Referring to FIGS. 1 and 3, the label transfer drum 18 may be broadly characterized as a label carrier having a movable surface. The drum includes a cylindrical surface 18*a*. Passages 18*b* extending through the cylindrical surface selectively communicate in a known manner with a vacuum established within an interior region of the drum and serve as a means for holding labels to the cylindrical surface.

Carried on the cylindrical surface 18*a* of the drum 18 are at least one set of first and second ridges 19*a*, 19*b* which project outwardly from the cylindrical surface. As illustrated in FIG. 1, three sets of ridges are arranged circumferentially about the cylindrical surface of drum 18. The ridges are aligned with the rotational axis of the drum and are circumferentially spaced from each other by a distance which is substantially the same as the distance between the first and second ends of a label. In the direction of rotation of the drum, the first ridge 19*a* leads the second ridge and will underlie the first end 30*a* of a label supplied from the label feeder 22. The second ridge 19*b* will underlie the second end 30*b* of the label. The ridges may be formed integrally with the drum 18 or, as illustrated, may be provided at the ends of a pad which is fastened to the cylindrical surface of the drum.

As best shown in FIG. 3, the first ridge 19*a* is defined by segments 19*a*' separated by a recess 19*a*". Vacuum is applied through passages 18*b* extending through the separate segments 19*a*' and the recess 19*a*" of the first ridge 19*a* and through the second ridge 19*b* ensures that the ends of the label are held to, and conform with, the ridges. The vacuum passages between the ridges ensure that the portion of the label between the ends 30*a*, 30*b* is held to the cylindrical surface of the drum and is closer than the ends to the rotational axis of the drum.

The adhesive applicator assembly 24 includes an adhesive applicator 25 in the form of a drum with a cylindrical adhesive-applying surface 25*a* positioned adjacent to the label transfer drum 18. In a known manner, a film of liquid adhesive is applied to the adhesive-applying surface from a source 25*b* of liquid adhesive. The adhesive applying surface 25*a* of drum 25 is spaced from the cylindrical surface 18*a* of the label transfer drum by a small distance which enables the adhesive-applying surface to contact the ridges 19*a*, 19*b*, but not the intervening cylindrical surface 18*a* of the label transfer drum 18, as the label transfer drum rotates. As illustrated, the adhesive applicator drum 25 rotates in a direction which is opposite to the rotation of the label transfer drum.

As best shown in FIGS. 1 and 3, the backing wall 20 includes a yieldable surface 21 which is spaced uniformly from the cylindrical surface 18*a* of the label transfer drum. That is, the yieldable surface 21 is arcuate and concentric with the cylindrical surface of drum 18. The spacing between the two confronting concentric surfaces is a little less than the width of the bottle to be labeled at the major diameter section 15*a* of the bulbous sidewall region.

In the operation of the labeling apparatus, as the label transfer drum 18 rotates, the label feeder 22 presents labels to the cylindrical surface of the drum in a timed sequence which causes the first and second ends of each label to overlie a first ridge 19*a* and a second ridge 19*b*, respectively, on the drum 18. The labels are held to the drum 18 and conform to the ridges by vacuum applied through passages 18*b*. As the labels are carried by the label transfer drum 18 past the adhesive applicator assembly 24, the ends of the labels contact the adhesive-applying surface 25*a* of drum 25 to thereby effect a transfer of adhesive onto the first and second ends of the labels. Outlying areas 30*e* along the first end 30*a* of the label which overlie the segments of first ridge 19*a* are coated with adhesive, but a central area of the first end of the label, which conforms to the recess 19*a*" between the segments 19*a*' of first ridge 19*a*, does not contact the surface of drum 25 and does not receive adhesive. A continuous strip of adhesive 30*f* is transferred onto the second end 30*b* of the label. The portion of the label between the ends, which is held against the cylindrical surface of the label transfer drum, does not contact the surface of drum 25 and does not receive adhesive.

The rotation of the label transfer drum 18 is coordinated with the approach of a bottle into the entrance of the arcuate passage 32 formed between the drum 18 and the backing wall 20. That is, as the bottle arrives at the entrance to the passage, coincidentally a first end 30*a* of a label, overlying a first ridge 19*a* on the drum 18, moves into contact with the bulbous sidewall region of the bottle. As shown in FIG. 3, the elevation of the recess 19*a*" between the segments of the first ridge 19*a* substantially coincides with the elevation of the major diameter section 15*a* of the bulbous sidewall region of the bottle, and the adhesive-carrying outlying areas 30*e* along the first end of the label make contact with the smaller diameter sections of the bulbous sidewall region above and below the major diameter section. Because the space between the outer surface of drum and the yieldable surface of backing wall is less than the width of the bottle at the major diameter section, the outlying areas along the first end of the label are pressed by the segments 19*a*' of the first ridge 19*a* on drum 18 against the smaller diameter sections of the bulbous sidewall region of the bottle. At these spaced locations of pressure application, the wall of a PET bottle will deform somewhat, and adhesive bonds will be produced. Between the adhesive bonds, the central area along the first end of the label, which overlies the major diameter section of the bulbous sidewall region, is not adhered to the bottle.

With the bulbous sidewall region of the bottle pressed between the outer surface of the label transfer drum 18 and the yieldable surface 21 of backing wall 20, continued rotation of the label transfer drum will cause rolling of the bottle over these confronting surfaces in the passage between these surfaces. As the bottle rolls over the cylindrical surface of the drum, the vacuum in the passages 18*b* which holds the label to the drum is sequentially relieved in a known manner, to permit the label to separate from the drum and wrap around the bulbous sidewall region of the bottle. The bottle rolls over the confronting surfaces of the drum 18 and the backing wall 20, and the label wraps about the bulbous sidewall region of the bottle, until the second end of the label confronts the first end of the label. The adhesive-carrying second end of the label is then pressed by the underlying second ridge 19*b* on drum 18 against the overlapped first end of the label, producing an adhesive bond beneath the second end of the label.

As the bottle rolls over the cylindrical surface of drum 18 and over the confronting yieldable surface 21 of the backing wall, and as the label wraps about the bulbous sidewall region of the bottle, the bulbous sidewall region is progressively pressed into, and deforms, the yieldable surface 21. Concurrently, the bulbous sidewall of a PET bottle will deform somewhat in response to the pressure applied by the confronting surfaces of the label transfer drum 18 and the backing wall 20. As a consequence, the yieldable surface 21 and the areas of the label pressed between the yieldable surface and the bulbous sidewall region of the bottle will conform to the bulbous sidewall region, to an extent which depends on factors including the curvature of the bulbous sidewall region, the magnitude of the pressure and the resistance to deformation which the bottle sidewall and the yieldable surface exhibit. If the curvature of the bulbous sidewall region is quite subtle, for example, the rolling of the bottle over the confronting surfaces of the drum 18 and the yieldable surface 21 may effect a nearly complete conformation of the side margins of the label with the underlying areas of the bulbous sidewall region.

After the wrapping and pressing of the label about the bulbous sidewall region of the bottle is complete, continued rotation of the label transfer drum 18 will roll the bottle with the applied label through the exit of the arcuate passage between the drum 18 and the backing wall 20 and will carried away by discharge conveyor 26. The bottles with the applied labels then enter a heating station 28.

If the label is of a heat-shrinkable sheet material, a heating station 28 may be employed to achieve the conformation of the side margins of the label with the underlying areas of the bulbous sidewall region. Alternatively, the heating station may be employed to augment the conformation of the side margins achieved by rolling the bottle over the confronting surfaces of the drum 18 and the backing wall 20. The heating station may be of known construction and operation and may, for example, employ nozzles which discharge heated gas onto the side margins of the wrapped label.

Figure 4:
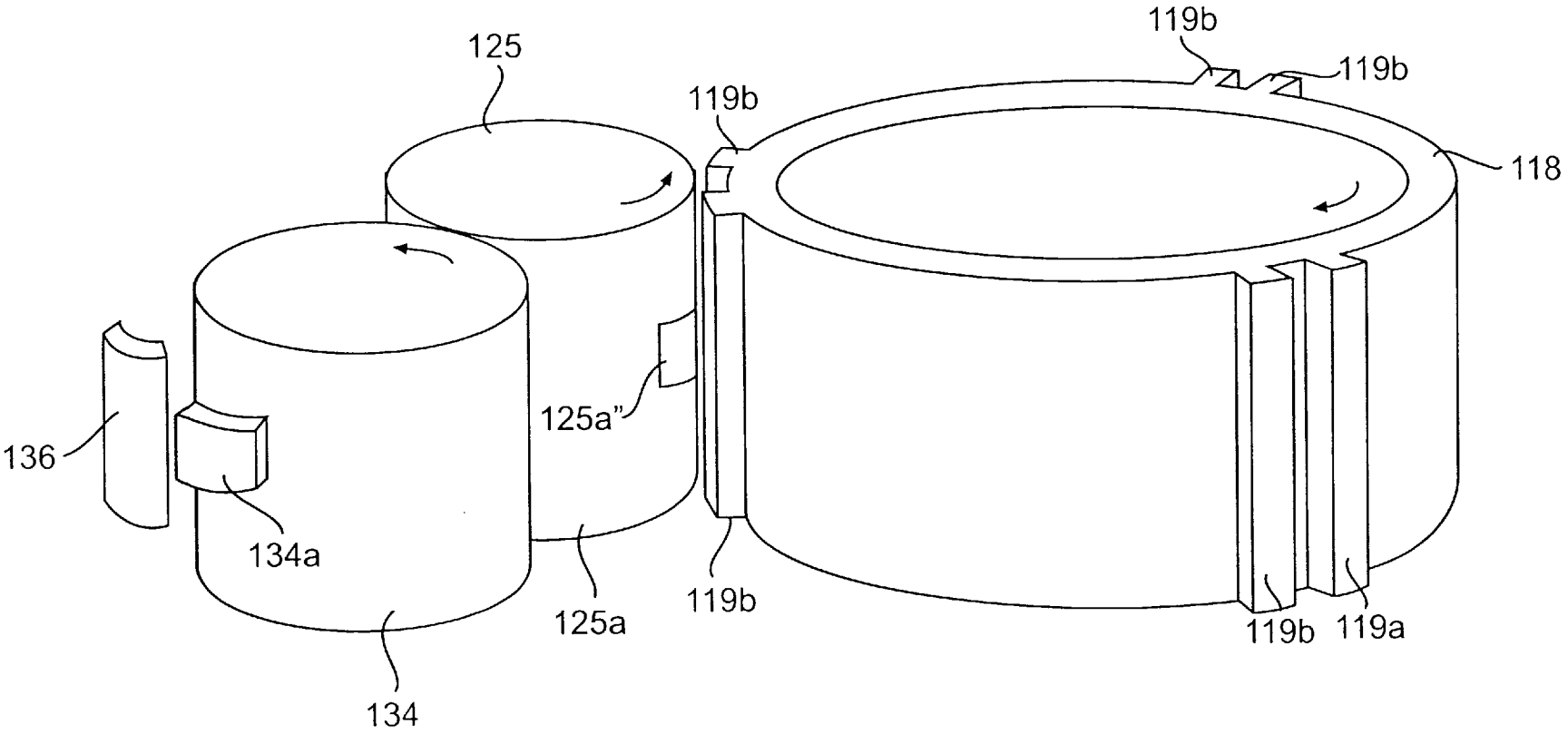
FIG. 4 is a perspective, partly schematic illustration showing the arrangement of the label transfer drum, the adhesive applicator drum, the adhesive removal drum and a doctor blade according to a second embodiment of the present invention.

Adhesive patches may be applied to the first end of the label using another method and apparatus of the present invention which employs modified first ridges on the label transfer drum which underlie the first end of the label and a modified adhesive applicator assembly, illustrated in FIG. 4. Adjacent to the adhesive applicator drum 125 is an adhesive removal drum 134 provided with a wiping element 134*a*. As the drum 134 rotates, the wiping element 134*a* will make periodic contact with the adhesive-applying surface 125*a* of drum 125 and will wipe adhesive from a discreet area 125*a*' of drum 125. A doctor blade 136 may be positioned adjacent to the adhesive removal drum 134 to engage the wiping element and thereby remove accumulated adhesive. The rotation of drum 125 is coordinated with the rotation of the label transfer drum 118 so that the adhesive-free area 125*a*' of drum 125 contacts a central area along the first end of a label overlying a first ridge 119*a* on the label transfer drum. The adhesive-carrying areas of drum 125 above and below the adhesive-free area will contact outlying areas along the first end of the label and transfer adhesive patches to these outlying areas. A circumferentially displaced area of drum 125 will contact the second end of the label and transfer a continuous strip of adhesive to a major portion of the second end of the label. The first ridges 119*a* on the label transfer drum may be formed like the second ridges 119*b*, i.e., without a recess, because no adhesive is presented by drum 125 to the central area along the first end of the label.

With adhesive patches applied to the first end of the label and a continuous strip of adhesive applied to the second end of the label, the ensuing operations of wrapping and pressing occur just as they do in the earlier described embodiment of the present invention.

Variations of the invention may become apparent from the foregoing disclosure. All such variations and modifications which would be obvious to persons of ordinary skill in the art should be regarded as falling within the scope of invention as defined in the following claims.

What is claimed is:

1. A process for applying a label bounded by side margins and first and second ends to a bulbous sidewall region of a container of generally circular cross-section, wherein the bulbous sidewall region includes a major diameter section between first and second sections which are of smaller diameter than the major diameter section, comprising the steps of:

placing the first end of the label over the bulbous sidewall region of the container so that a central area of the first end of the label overlies the major diameter section of the bulbous sidewall region;

placing first and second outlying areas separated by the central area of the first end of the label around the major diameter section and upon the first and second smaller diameter sections of the bulbous sidewall region such that the first and second outlying areas of the first end of the label are joined to the bulbous sidewall region at locations within the first and second smaller diameter sections, while the central area of the first end of the label overlies, and is not joined to, the major diameter section of the bulbous sidewall region;

wrapping the label about the bulbous sidewall region until the second end of the label confronts the bulbous sidewall region;

joining the second end of the label to the bulbous sidewall region; and forming the side margins of the label against underlying areas of the bulbous sidewall region.

2. The process as recited in claim 1, wherein the step of placing and joining the first and second outlying areas further comprises the substeps of:

applying adhesive patches to the first and second outlying areas only of the first end of the label;

placing the first end of the label over the bulbous sidewall region such that the adhesive patches on the outlying areas confront each of the first and second smaller diameter sections;

pressing the first and second outlying areas against the bulbous sidewall region to produce adhesive bonds where each of the first and second outlying areas contact the bulbous sidewall region.

3. The process as recited in claim 2, wherein the step of pressing the first and second outlying areas further comprises the substep of:

applying pressure at spaced locations within each of the first and second outlying areas so as to press each of the first and second outlying areas against the first and second smaller diameter sections of the bulbous sidewall region.

4. The process as recited in claim 1 wherein the step of wrapping the label further comprises:

while wrapping the label, progressively pressing the label against the bulbous sidewall region.

5. The process as recited in claim 1 wherein the label is formed of heat-shrinkable material, and the step of forming the side margins further comprises:

applying heat to the side margins of the label to shrink the side margins and thereby achieve conformance of the side margins with the underlying areas of the bulbous sidewall region.

6. The process as recited in claim 1, wherein the step of placing the central area of the first end of the label so as to overlie the major diameter section of the bulbous sidewall region occurs before the step of placing the first and second outlying areas around the major diameter section and upon the first and second smaller diameter sections of the bulbous sidewall region.

7. The process as recited in claim 1, wherein the step of placing the first and second outlying areas around the major diameter section and upon the first and second smaller diameter sections of the bulbous sidewall region occurs without substantially deforming a bulbous shape formed by the major diameter section and the first and second smaller diameters sections of the bulbous sidewall region.

8. A process for applying a label bounded by side margins and first and second ends to a bulbous sidewall region of a container of generally circular cross-section, wherein the bulbous sidewall region includes a major diameter section between sections which are of smaller diameter than the major diameter section, comprising the steps of:

applying adhesive patches to spaced outlying areas separated by a central area of the first end of the label;

applying a continuous strip of adhesive to a major portion of the second end of the label between the side margins;

placing the first end of the label over the bulbous sidewall region such that the central area of the first end of the label overlies the major diameter section of the bulbous sidewall region;

placing the outlying areas of the first end of the label around the major diameter section and upon the smaller diameter sections of the bulbous sidewall region such that the adhesive patches on the outlying areas confront each of the smaller diameter sections;

pressing the outlying areas against the bulbous sidewall region to produce adhesive bonds where the outlying areas contact the smaller diameter sections of the bulbous sidewall region;

wrapping the label about the bulbous sidewall region until the second end of the label overlaps and confronts the first end of the label;

pressing the second end of the label against the first end and the underlying bulbous sidewall region to produce an adhesive bond between the overlapped ends of the label; and forming the side margins of the label against underlying areas of the bulbous sidewall region.

9. The process as recited in claim 8 wherein the label is formed of heat-shrinkable material, and the step of forming the side margins further comprises:

applying heat to the side margins of the label to shrink the side margins and thereby achieve conformance of the side margins with the underlying areas of the bulbous sidewall region.

10. The process as recited in claim 8 wherein the step of wrapping the label further comprises:

while wrapping the label, progressively pressing the label against the bulbous sidewall region.

11. The process as recited in claim 8, wherein the step of pressing the outlying areas further comprises the substep of:

applying pressure at spaced locations within each of the outlying areas so as to press each of the outlying areas against the smaller diameter sections of the bulbous sidewall region.

12. The process as recited in claim 8, wherein the step of placing the central area of the first end of the label so as to overlie the major diameter section of the bulbous sidewall region occurs before the step of placing the outlying areas around the major diameter section and upon the smaller diameter sections of the bulbous sidewall region.

13. The process as recited in claim 8, wherein the step of placing the outlying areas around the major diameter section and upon the smaller diameter sections of the bulbous sidewall region occurs without substantially deforming a bulbous shape defined by the major diameter section and the smaller diameters sections of the bulbous sidewall region.

14. A process for applying a label bounded by side margins and first and second ends to a bulbous sidewall region of a container of generally circular cross-section, wherein the bulbous sidewall region includes a major diameter section between sections which are of smaller diameter than the major diameter section, comprising the steps of:

placing the first end of the label over the bulbous sidewall region of the container so that a central area of the first end of the label overlies the major diameter of the bulbous sidewall region;

placing outlying areas separated by the central area of the first end of the label about the major diameter section and upon the smaller diameter section of the bulbous sidewall region such that the outlying areas of the first end of the label are joined to the bulbous sidewall region at locations within the smaller diameter sections, while the central area of the first end of the label overlies, and is not joined to, the major diameter section of the bulbous sidewall region;

positioning the bulbous sidewall region and the first end of the label against a yieldable surface;

rolling the container over the yieldable surface while urging the container against the yieldable surface to wrap the label about the bulbous sidewall region until the second end of the label confronts the bulbous sidewall region, cause deformation of the yieldable surface while progressively pressing the label between the bulbous sidewall region and the yieldable surface, and effect a progressive conformation of the side margins of the label over the underlying areas of the bulbous sidewall region; and joining the second end of the label to the bulbous sidewall region.

15. The process as recited in claim 14, wherein the step of placing and joining outlying areas comprises the substeps of:

applying adhesive patches to the outlying areas of the first end of the label;

placing the first end of the label over the bulbous sidewall region such that the adhesive patches on the outlying areas confront each of the smaller diameter sections; and pressing the outlying areas against the bulbous sidewall regions to produce adhesive bonds where each of the outlying areas contact the bulbous sidewall region.

16. The process as recited in claim 15, wherein the step of pressing the outlying areas further comprises the substep of:

applying pressure at spaced locations within each of the outlying areas so as to press each of the outlying areas against the smaller diameter sections of the bulbous sidewall region.

17. The process as recited in claim 14 wherein the label is formed of heat-shrinkable material, and further comprising the step of:

applying heat to the side margins of the label to shrink the side margins and thereby achieve additional conformance of the side margins with the underlying areas of the bulbous sidewall region.

18. The process as recited in claim 14, wherein the step of placing the central area of the first end of the label so as to overlie the major diameter section of the bulbous sidewall region occurs before the step of placing the outlying areas around the major diameter section and upon the smaller diameter sections of the bulbous sidewall region.

19. The process as recited in claim 14, wherein the step of placing the outlying areas about the major diameter section and upon the smaller diameter sections of the bulbous sidewall region occurs without substantially deforming a bulbous shape formed by the major diameter section and the smaller diameters sections of the bulbous sidewall region.

20. A process for applying a label bounded by side margins and first and second ends to a bulbous sidewall region of a container of generally circular cross-section, wherein the bulbous sidewall region includes a major diameter section between section which are of smaller diameter than the major diameter section, comprising the steps of:

applying adhesive patches to the outlying areas separated by a central area of the first of the label;

applying a continuous strip of adhesive to a major portion of the second end of the label between the side margins;

placing the first end of the label over the bulbous sidewall region such that the central area of the label overlies the major diameter section of the bulbous sidewall region:

placing the outlying areas of the first end of the label about the major diameter section and upon the smaller diameter sections such that the adhesive on the outlying areas confronts the smaller diameter sections;

pressing the outlying areas against the bulbous sidewall regions to produce adhesive bonds where the outlying areas contact the bulbous sidewall region;

positioning the bulbous sidewall region and the first end of the label against a yieldable surface; and rolling the container over the yieldable surface while urging the container against the yieldable surface to (1) wrap the label about the bulbous sidewall regions until the second end of the label overlaps and confronts the first end of the label, (2) cause deformation of the yieldable surface while progressively pressing the label between the bulbous sidewall region and the yieldable surface, (3) effect a progressive conformation of the side margins of the label over the underlying areas of the bulbous sidewall region, and (4) press the second end of the label against the first end and the underlying bulbous sidewall region to produce an adhesive bond between the overlapped ends of the label.

21. The process as recited in claim 20 wherein the label is formed of heat-shrinkable material, and further comprising the step of:

applying heat to the side margins of the label to shrink the side margins and thereby achieve additional conformance of the side margins with the underlying areas of the bulbous sidewall region.

22. The process as recited in claim 20, wherein the step of pressing the outlying areas further comprises the substep of:

applying pressure at spaced locations within each of the outlying areas so as to press each of the outlying areas against the smaller diameter sections of the bulbous sidewall region.

23. The process as recited in claim 20, wherein the step of placing the central area of the first end of the label so as to overlie the major diameter section of the bulbous sidewall region occurs before the step of placing the outlying areas around the major diameter section and upon the smaller diameter sections of the bulbous sidewall region.

24. The process as recited in claim 20, wherein the step of placing the outlying areas about the major diameter section and upon the smaller diameter sections of the bulbous sidewall region occurs without substantially deforming a bulbous shape defined by the major diameter section and the smaller diameters sections of the bulbous sidewall region.

25. An apparatus for applying a label bounded by side margins and first and second ends to a bulbous sidewall region of a container of generally circular cross-section, wherein the bulbous sidewall region includes a major diameter section between sections which are of smaller diameter than the major diameter section, the apparatus comprising:

means for placing the first end of the label over the bulbous sidewall region of the container so that a central area of the first end of the label overlies the major diameter of the bulbous sidewall region;

means for placing outlying areas separated by the central area of the first end of the label about the major diameter section and upon the smaller diameter section of the bulbous sidewall region such that the outlying areas of the first end of the label are joined to the bulbous sidewall region at locations within the smaller diameter sections, while the central area of the first end of the label overlies, and is not joined to, the major diameter section of the bulbous sidewall region;

means for wrapping the label about the container until the second end of the label confronts the bulbous sidewall region;

means for joining the second end of the label to the bulbous sidewall region; and means for forming the side margins of the label against underlying areas of the bulbous sidewall region.

26. The apparatus as recited in claim 25, wherein the means for placing and joining outlying areas comprises:

means for applying adhesive patches to the outlying areas only of the first end of the label;

means for placing the first end of the label over the bulbous sidewall region such that the adhesive on the outlying areas confront each of the smaller diameter sections; and means for pressing the outlying areas against the bulbous sidewall region to produce adhesive bonds where each of the outlying areas contact the bulbous sidewall region.

27. The apparatus as recited in claim 26, wherein the means for applying adhesive patches comprises:

a rotatable drum having a cylindrical surface which carries at least one ridge extending transversely across the cylindrical surface, the ridge including outwardly projecting segments separated by a recess;

an adhesive applicator having an adhesive-applying surface disposed adjacent to the drum so as to contact the ridge but not the cylindrical surface of the drum as the drum rotates;

means for releasably holding the label to the drum with the first end of the label overlying and conforming to the ridge;

means for rotating the drum and the label to thereby effect contact of the adhesive-applying surface with the outlying areas of the first end of the label which overlie the outwardly projecting segments of the ridge.

28. The apparatus as recited in claim 27, wherein the drum is disposed in confronting relation to the container, and the means for pressing comprises:

means for further rotating the drum and the label to thereby press the outlying areas of the first end of the label between the outwardly projecting segments of the ridge and the bulbous sidewall region of the container and produce the adhesive bonds where the outlying areas contact the bulbous sidewall region.

29. The apparatus as recited in claim 27 wherein the means for releasably holding comprises:

a vacuum source which communicates with an interior region of the drum; and passages which extend through the ridge and the cylindrical surface and afford communication with the interior region and the vacuum source; whereby the label is releasably held to the drum and held in conformance with the ridge by vacuum.

30. The apparatus as recited in claim 27 wherein the adhesive-applying surface carries an adhesive film that confronts the outwardly projecting segments and the recess of the ridge as the adhesive-applying surface contacts the ridge.

31. The apparatus as recited in claim 26 wherein the means for applying adhesive patches comprises:

a rotatable first drum having a cylindrical surface which carries at least one outwardly projecting ridge extending transversely across the cylindrical surface;

an adhesive applicator having spaced adhesive-applying surfaces disposed adjacent to the drum, whereby the spaced adhesive-applying surfaces contact axially spaced segments of the ridge but do not contact (1) a region of the ridge between the spaced segments and (2) the cylindrical surface of the drum, as the drum rotates;

means for releasably holding the label to the drum with the first end of the label overlying and conforming to the ridge;

means for rotating the drum and the label to thereby effect contact of the spaced adhesive-applying surfaces with the outlying areas of the first end of the label which overlie the axially spaced segments of the ridge.

32. The apparatus as recited in claim 31 wherein the adhesive applicator comprises:

a rotatable second drum having a cylindrical surface disposed adjacent to the first drum so as to contact the ridge but not the cylindrical surface of the first drum as the first drum rotates;

means for applying adhesive to the cylindrical surface of the second drum; and means for removing a patch of adhesive from the surface of the second drum to thereby leave spaced adhesive-applying surfaces which contact axially spaced segments of the ridge carried by the first drum.

33. The apparatus as recited in claim 32 wherein the means for removing comprises:

a rotatable adhesive removal drum which carries a projecting element, the adhesive removal drum being disposed adjacent to the second drum so that wiping contact of the projecting element with the second drum occurs as the adhesive removal drum rotates; and means for rotating the adhesive removal drum to thereby effect the removal of a patch of adhesive from the surface of the second drum.

34. The apparatus as recited in claim 33, and further comprising:

a stationary wiping element adjacent to the adhesive removal drum so as to contact the projecting element as the adhesive removal drum rotates to thereby remove accumulated adhesive from the projecting element.

35. The apparatus as recited in claim 31 wherein the projection of the ridge from the cylindrical surface is uniform throughout the transverse extent of the ridge.

36. The apparatus as recited in claim 26 wherein the means for joining the second end of the label comprises:

means for applying a continuous strip of adhesive to a major portion of the second end of the label between the side margins; and means for pressing the second end of the label against the bulbous sidewall region to produce an adhesive bond where the second end of the label contacts the bulbous sidewall region.

37. The apparatus as recited in claim 36 wherein the means for applying adhesive patches and the means for means for applying a continuous strip of adhesive comprise:

a rotatable drum having a cylindrical surface which carries at least two circumferentially spaced ridges extending transversely across the cylindrical surface, a first one of the ridges including outwardly projecting segments separated by a recess;

an adhesive applicator having an adhesive-applying surface disposed adjacent to the drum so as to contact the ridges but not the cylindrical surface of the drum as the drum rotates;

means for releasably holding the label to the drum with the first end of the label overlying and conforming to the first ridge and the second end of the label overlying and conforming to the other ridge;

means for rotating the drum and the label to thereby effect contact of the adhesive-applying surface with (1) the outlying areas of the first end of the label which overlie the outwardly projecting segments of the first ridge and (2) the second end of the label which overlies the other ridge.

38. The apparatus as recited in claim 37, wherein the drum is disposed in confronting relation to the container, and the means for applying pressure and the means for pressing the second end of the label comprise:

means for further rotating the drum and the label to thereby press the outlying areas of the first end of the label between the outwardly projecting segments of the first ridge and the bulbous sidewall region of the container and produce the adhesive bonds where the outlying areas contact the bulbous sidewall region; and means for further rotating the drum and the label to thereby press the second end of the label between the other ridge and the bulbous sidewall region of the container and produce an adhesive bond where the second end of the label contacts the bulbous sidewall region.

39. The apparatus as recited in claim 37 wherein the means for releasably holding comprises:

a vacuum source which communicates with an interior region of the drum; and passages which extend through the ridges and the cylindrical surface and afford communication with the interior region and the vacuum source; whereby the label is releasably held to the drum and held in conformance with the ridges by vacuum.

40. The apparatus as recited in claim 36 wherein the means for applying adhesive patches and for means for applying a continuous strip of adhesive comprise:

a rotatable drum having a cylindrical surface which carries at least two circumferentially spaced ridges extending transversely across the cylindrical surface;

an adhesive applicator having first spaced adhesive-applying surfaces and a second adhesive-applying surface disposed adjacent to the drum, whereby (1) the first spaced adhesive-applying surfaces contact axially spaced segments of a first ridge but do not contact a region of the first ridge between the spaced segments, (2) the second adhesive-applying surface contacts the other ridge and (3) neither of the first and second adhesive-applying surfaces contacts the cylindrical surface of the drum, as the drum rotates;

means for releasably holding the label to the drum with the first end of the label overlying and conforming to the first ridge and the second end of the label overlying and conforming to the other ridge;

means for rotating the drum and the label to thereby effect contact of (1) the first spaced adhesive-applying surfaces with the outlying areas of the first end of the label which overlie the axially spaced segments of the ridge and (2) the second adhesive-applying surface with the second end of the label which overlie the other ridge.

41. The apparatus as recited in claim 40 wherein the adhesive applicator comprises:

a rotatable second drum having a cylindrical surface disposed adjacent to the first drum so as to contact the ridges but not the cylindrical surface of the first drum as the first drum rotates;

means for applying adhesive to the cylindrical surface of the second drum; and means for removing a patch of adhesive from the surface of the second drum to thereby leave (1) first spaced adhesive-applying surfaces which contact axially spaced segments of the first ridge carried by the first drum and (2) a second adhesive-applying surface which contacts the other ridge carried by the first drum.

42. The apparatus as recited in claim 41 wherein the means for removing comprises:

a rotatable adhesive removal drum which carries a projecting element, the adhesive removal drum being disposed adjacent to the second drum so that wiping contact of the projecting element with the second drum occurs as the adhesive removal drum rotates; and means for rotating the adhesive removal drum to thereby effect the removal of a patch of adhesive from the surface of the second drum.

43. The apparatus as recited in claim 42, and further comprising:

a stationary wiping element adjacent to the adhesive removal drum so as to contact the projecting element as the adhesive removal drum rotates to thereby remove accumulated adhesive from the projecting element.

44. The apparatus as recited in claim 25 wherein the means for wrapping and the means for forming comprise:

a label carrier having a movable surface;

means for releasably holding the label to the movable surface with the side margins of the label aligned with the direction of movement of the movable surface;

a yieldable surface which is uniformly spaced from the movable surface by a distance which is slightly less than the width of the container at the major diameter section;

means for introducing the container within the space between the label on the movable surface and the yieldable surface; and means for moving the movable surface to cause rolling of the container over the yieldable surface to thereby (1) wrap the label about the bulbous sidewall region until the second end of the label confronts the bulbous sidewall region, (2) cause deformation of the yieldable surface while progressively pressing the label between the bulbous sidewall region and the yieldable surface and (3) effect a progressive conformation of the side margins of the label over the underlying areas of the bulbous sidewall region.

45. The apparatus as recited in claim 44 wherein the movable surface of the label carrier is cylindrical, and the yieldable surface is arcuate and concentric with the movable surface.

46. The apparatus as recited in claim 44 wherein the label is formed of heat-shrinkable material, and further comprising:

means for applying heat to the side margins of the label to shrink the side margins and thereby achieve additional conformance of the side margins with the underlying areas of the bulbous sidewall region.

47. The apparatus as recited in claim 25 wherein the means for forming comprises:

means for applying heat to the side margins of the label to shrink the side margins and thereby achieve conformance of the side margins with the underlying areas of the bulbous sidewall region.

48. The apparatus as recited in claim 25, wherein the central area of the first end of the label is placed so as to overlie the major diameter section of the bulbous sidewall region before the outlying areas are placed around the major diameter section and upon the smaller diameter sections of the bulbous sidewall region.

49. The apparatus as recited in claim 25, wherein the means for placing is configured so as to place the outlying areas about the major diameter section and upon the smaller diameter sections of the bulbous sidewall region without substantially deforming a bulbous shape formed by the major diameter section and the smaller diameters sections of the bulbous sidewall region.

50. The apparatus as recited in claim 25, wherein the first label end placing device places the outlying areas about the major diameter section and upon the smaller diameter sections of the bulbous sidewall region without substantially deforming a bulbous shape defined by the major diameter section and the smaller diameters sections of the bulbous sidewall region.

51. The apparatus as recited in claim 26, wherein the means for pressing applies pressure at spaced locations within the outlying areas to press each of the outlying areas against each of the smaller diameter sections of the bulbous sidewall region.

52. An apparatus for applying a label bounded by side margins and first and second ends to a bulbous sidewall region of a container of generally circular cross-section, wherein the bulbous sidewall region includes a major diameter section between sections which are of smaller diameter than the major diameter section, the apparatus comprising:

a first label end placing device for placing the first end of the label over the bulbous sidewall region of the container so that a central area of the first end of the label overlies the major diameter of the bulbous sidewall region, and placing outlying areas separated by the central area of the first end of the label about the major diameter section and upon the smaller diameter section of the bulbous sidewall region such that the outlying areas are joined to the bulbous sidewall region at locations within the smaller diameter sections, while the central area overlies, and is not joined to, the major diameter of the bulbous sidewall region;

a wrapping device for wrapping the label around the container until the second end of the label confronts the bulbous sidewall region;

a joining device for joining the second end of the label to the bulbous sidewall region; and a label side margin forming device for forming the side margins of the label against underlying areas of the bulbous sidewall region.

53. The apparatus as recited in claim 52, wherein the first label end placing device further comprises:

an adhesive application device for applying adhesive patches to the outlying areas of the first end of the label;

a placing device for placing the first end of the label over the bulbous sidewall region such that the adhesive on the outlying areas confront each of the smaller diameter section of the bulbous sidewall region;

a pressing device for pressing the outlying areas against the bulbous sidewall region to produce adhesive bonds where each of the outlying areas contact the bulbous sidewall region.

54. The apparatus as recited in claim 52, wherein the first label end placing device places the central area of the first end of the label so as to overlie the major diameter section of the bulbous sidewall region before placing the outlying areas are placed around the major diameter section and upon the smaller diameter sections of the bulbous sidewall region.

* * * * *